United States Patent [19]

Blackburn

[11] Patent Number: 4,768,782

[45] Date of Patent: Sep. 6, 1988

[54] BICYCLE EXERCISING APPARATUS

[75] Inventor: James R. Blackburn, Los Gatos, Calif.

[73] Assignee: Blackburn Designs, Inc., Campbell, Calif.

[21] Appl. No.: 12,558

[22] Filed: Feb. 9, 1987

[51] Int. Cl.[4] ..... A63B 21/00

[52] U.S. Cl. ..... 272/73; 272/130

[58] Field of Search ..... 272/73, 73.1, 73.2

[56] References Cited

U.S. PATENT DOCUMENTS

| | | | |
|---|---|---|---|
| 591,969 | 10/1897 | Hiekisch | 272/73 X |
| 2,043,977 | 6/1936 | Back | 272/73.1 |
| 3,056,603 | 10/1962 | Levine et al. | 272/73 |
| 3,572,758 | 3/1971 | Lee | 272/73.1 |
| 3,866,908 | 2/1975 | Hangler | 272/73.1 |

FOREIGN PATENT DOCUMENTS

| | | | |
|---|---|---|---|
| 7307839 | 10/1974 | France | 272/73 |

OTHER PUBLICATIONS

Sears 1985 Fall-Winter Catalog, p. 657, Item #8.

*Primary Examiner*—Richard J. Apley
*Assistant Examiner*—Franklin Gubernick
*Attorney, Agent, or Firm*—Robert O. Guillot

[57] ABSTRACT

A bicycle exercising apparatus which allows the user to place the rear wheel of a bicycle therein for stationary pedaling exercise. The apparatus supports the rear wheel of the bicycle and does not require the removal of the front wheel. The frame of the apparatus forms a support to the rear axle of the rear wheel, and an adjustable load mechanism, including a fly wheel and a wind cage, provides a resistance against the pedaling force of the user. The elements of the frame may be pivotally connected such that the frame is collapsable for ease of transportation and storage.

15 Claims, 6 Drawing Sheets

BICYCLE EXERCISING APPARATUS

BACKGRUND OF THE INVENTION

1. Field of the Invention

The present invention relates generally to bicycle exercising devices which hold a bicycle in a stationary position and supply a load to the rear wheel, and more particularly to a bicycle exercising device which supports only the rear wheel utilizing a frame which is collapsable for ease of transportation and storage.

2. Description of the Prior Art

Bicycle exercising devices which support the frame of a bicycle have been known for several decades. Typically, such devices support the bicycle frame at two locations, such as the front fork and crank hub, the crank hub and rear axle, or the front fork and rear axle. Typical examples of such devices are found in U.S. Pat. No. 4,441,705; U.S. Pat. No. 589,705; German Patent No. 517,774; and copending U.S. Design patent application Ser. No. 06/806,851, by James R. Blackburn the inventor hereof.

A recent upsurge of interest in bicycle riding has resulted in a similar upsurge in bicycle exercising devices, now called trainers. Depiction of these new trainers can be found in Bicycling Magazine, October 1986 on pages 10, 13, 35, 40, 43, 58, 67 and 97. The instant invention is depicted on page 52 of the October 1986 Bicycling Magazine. Likewise, the Performance Bicycle Shop Catalog, Fall 1986, depicts several trainers on pages 30, 31 and 32; the instant invention is depicted on page 32. The "Piggy Back Trainer" and "Vortex Trainer by Eclipse", both depicted on page 32 of the Performance Bicycle Shop Catalog, Fall 1986, are examples of recent prior art which support the bicycle at the rear wheel axle only, as does the instant invention. The instant invention differs from the prior art in the structural frame work which supports the bike, as well as the collapsable nature of the instant invention which facilitates ease of transportation and storage.

SUMMARY OF THE INVENTION

It is an object of the present invention to provide a bicycle exercising apparatus which firmly supports the bicycle only at the rear axle.

It is another object of the present invention to provide a bicycle exercising apparatus which includes a triangulated frame structure and a broad base to provide support for the rear axle of a bicycle.

It is a further object of the present invention to provide a bicycle exercising apparatus having a fly wheel and fan cage disposed in an adjustable manner for providing a load to bicycle rear wheels of different diameters.

It is yet another object of the present invention to provide a bicycle exercising apparatus which contains frame elements that pivot relative to one another, such that the apparatus is easily collapsed to facilitate transportation and storage.

The bicycle exercising apparatus of the present invention includes a frame for supporting the rear wheel of a bicycle at the axle thereof, and a load mechanism to provide resistance when the user pedals the bicycle. The frame includes elements which form a structural support for each side of the axle and laterally disposed legs which form a broad base to prevent tipping of the apparatus while in use. The frame elements are pivotally joined at their upper vertex proximate the support point of the rear axle and a tension member forms the frame element opposite the pivoting vertex. For ease of transportation and storage the apparatus may be collapsed through compression across the tension member and pivoting at the opposite vertex.

It is an advantage of the present invention that it provides a bicycle exercising apparatus which firmly supports the bicycle only at the rear axle.

It is another advantage of the present invention that it provides a bicycle exercising apparatus which includes a triangulated frame structure and a broad base to provide support for the rear axle of a bicycle.

It is a further advantage of the present invention that it provides a bicycle exercising apparatus having a fly wheel and fan cage disposed in an adjustable manner for providing a load to bicycle rear wheels of different diameters.

It is yet another advantage of the present invention that it provides a bicycle exercising apparatus which contains frame elements that pivot relative to one another, such that the apparatus is easily collapsed to facilitate transportation and storage.

The forgoing and other objects, features and advantages of the invention will be apparent from the following description of the preferred embodiment which makes reference to the several figures of the drawing.

IN THE DRAWING

DESCRIPTION OF THE PREFERRED EMBODIMENT

Figure 1:
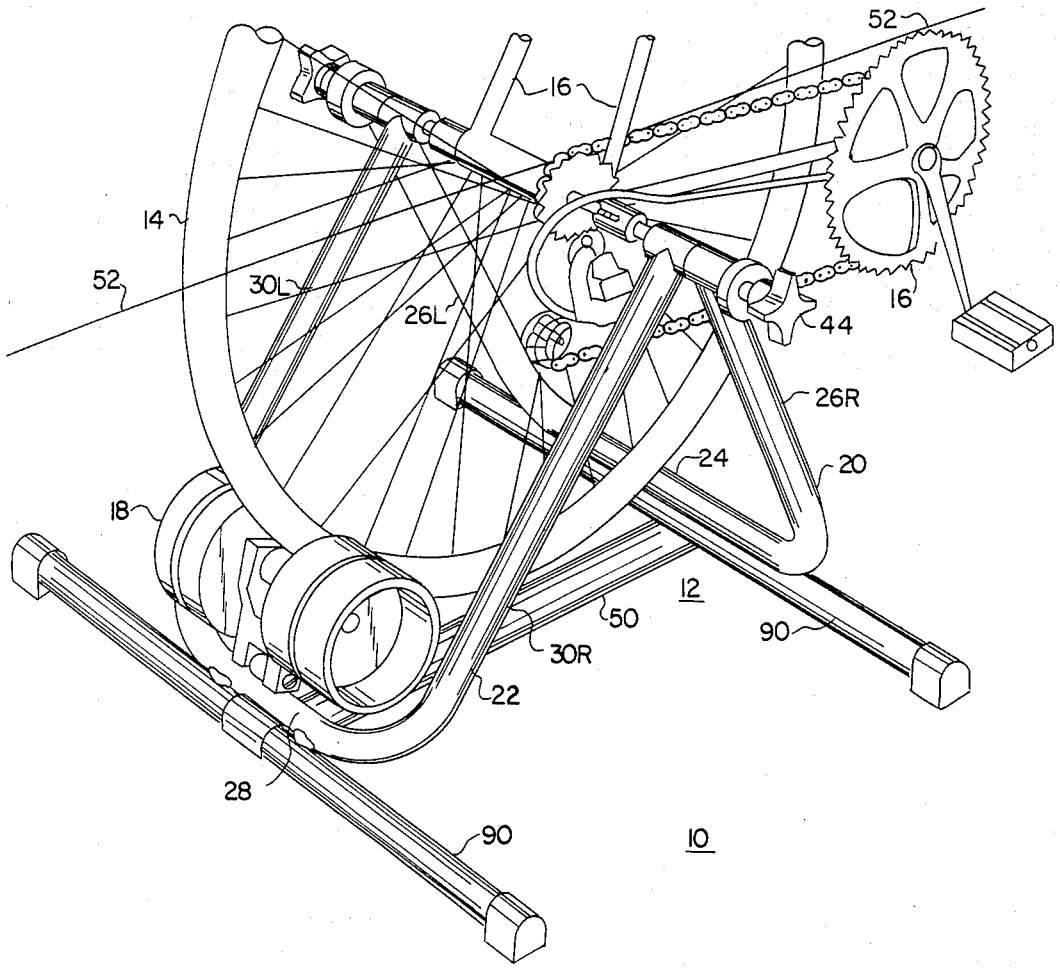
FIG. 1 is a perspective view of the bicycle exercising apparatus of the present invention depicting a bicycle rear wheel disposed therein.

As depicted in FIGS. 1, 2, 3 and 4, the present invention 10 includes a frame 12 that serves to support the rear wheel 14 of a bicycle 16 (partially depicted in FIG. 1). The rear wheel 14 engages a load member 18, such that the pedaling of the bicycle by the user causes the rear wheel to rotate the load member 18 to provide resistance and thus exercise to the user. The front wheel of the bicycle rests on the ground and requires no support.

The frame 12 includes a forward substantially U-shaped support bracket 20 and a rearward substantially U-shaped support bracket 22. The U-shaped bracket 20 is disposed such that the base 24 of the "U" is positioned towards the ground and the two arms 26R and 26L project upwardly. Likewise, the U-shaped bracket 22 is disposed such that the base 28 of the "U" is positioned towards the ground and the two arms 30R and 30L project upwardly. Each U-shaped member 20 and 22 is further positioned such that the rear wheel 14 is disposed to rotate within the open mouth of the "U" shape, that is, between the arms of each "U", such that one arm 26R and 30R of each U-shaped bracket is disposed on one side of the rear wheel 14 and the other arm 26L and 30L of each U-shaped bracket is disposed on the other side of the rear wheel 14.

Figure 3:
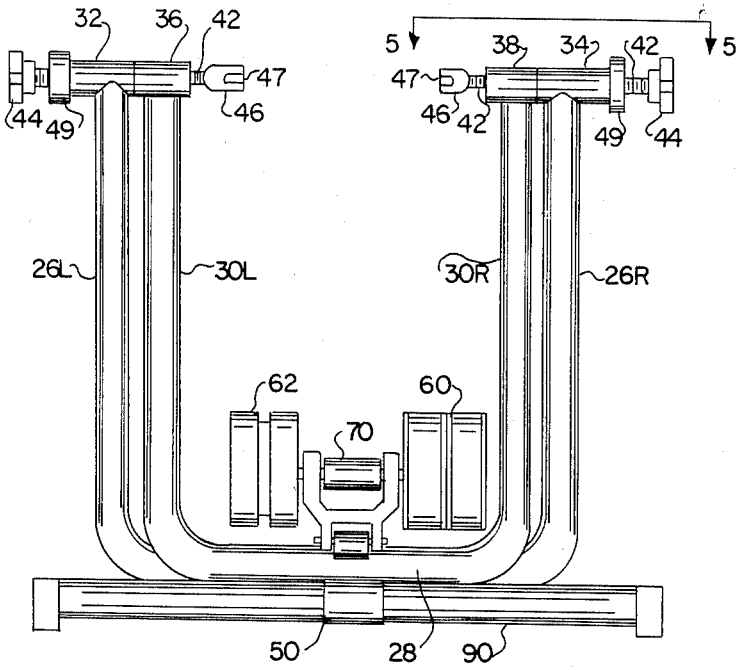
FIG. 3 is an end elevational view of the present invention.
Figure 4:
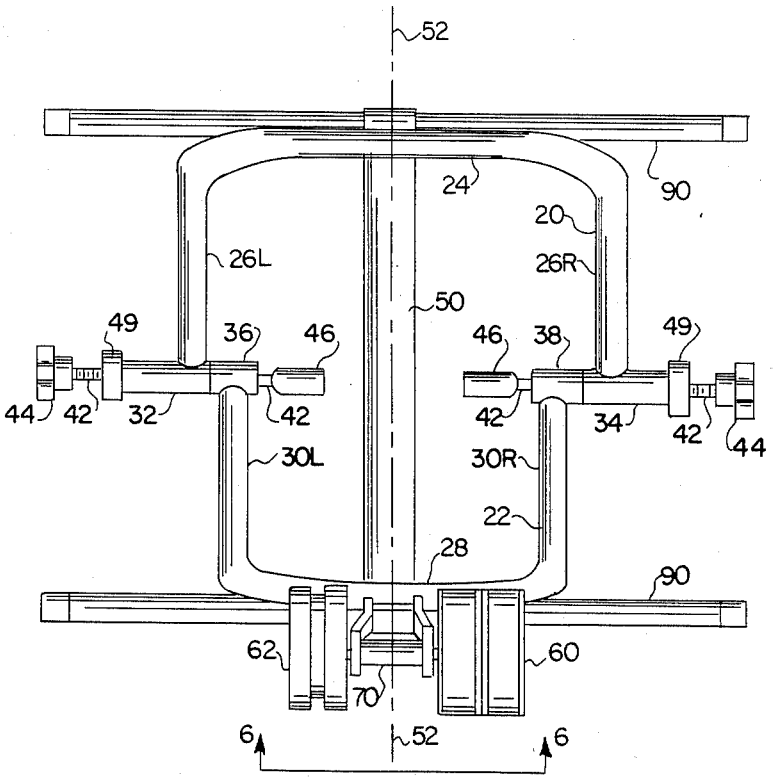
FIG. 4 is a top plan view of the present invention.
Figure 5:
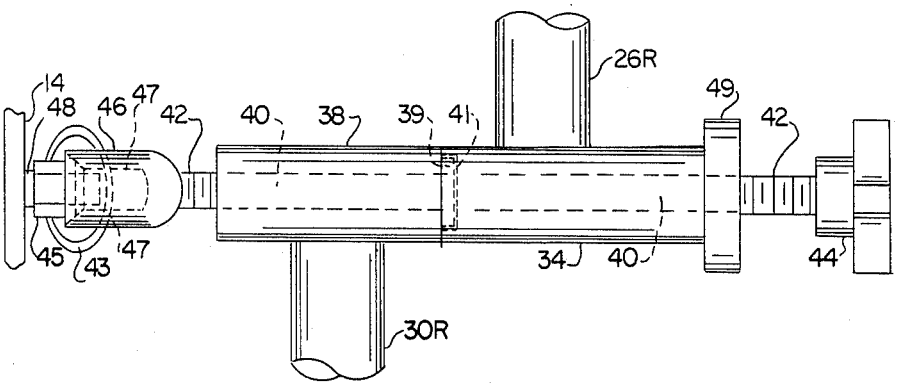
FIG. 5 is a top plan view taken along lines 5—5 of FIG. 3.

As is additionally depicted in FIG. 5, the upper end of each of the arms 26L, 26R, 30L and 30R of each U-shaped bracket 20 and 22 is joined to a horizontally disposed tubular mount 32, 34, 36, 38 respectively. Each mount has a mounting hole 40 formed axially therethrough; the mounting hole 40 of the inner mounts 36 and 38 is threaded for engagement with a mounting bolt 42, whereas the mounting hole 40 of the outer mounts 32 and 34 is not threaded. As is best depicted in FIGS. 1, 3 and 4 the lateral distance between the arms 30R and 30L of the rearward U-shaped bracket 22 is less than the lateral distance between the arms 26R and 26L of the forward U-shaped bracket 20, such that the mounting holes 40 in the inner mounts 36 and 38 of the arms of the rearward U-shaped bracket 22 may be placed within and aligned with the mounting holes 40 in the outer mounts 36 and 38 of the forward U-shaped bracket 20. The inner mounts 36 and 38 are each formed with a protruding lip 39 that nests within a cupped recess 41 formed in each of the outer mounts 32 and 34 respectively to strengthen the alignment of the inner and outer mounts. A threaded wheel mounting bolt 42 is disposed to pass through the aligned mounting holes of the mounts disposed on each side of the rear wheel when the U-shaped brackets 20 and 22 are properly aligned. A mounting bolt handle 44 is engaged to the outer end of each mounting bolt 42 to facilitate the rotation of the mounting bolt in its threaded engagement in the mounting holes 40 of the mounts 38 and 36. The inner end of each mounting bolt 42 is formed with an axle engaging cup 46 which acts to engage and support the protruding axle 48 of the rear wheel 14. A mounting slot 47, having a width which permits the ring 43 of a quick release nut 45 on the end of the axle 48 to pass threrethrough, may be formed in the sides of the cup 46 to facilitate the mounting and dismounting of the axle 48 in the cups 46. It is therefore to be understood that the mounting bolts 42 may be screwed inwardly from each side of the rear wheel 14, such that the axle 48 of the rear wheel 14 is held in the mounting cups 46 that project inwardly from each side of the frame 12.

Figure 2:
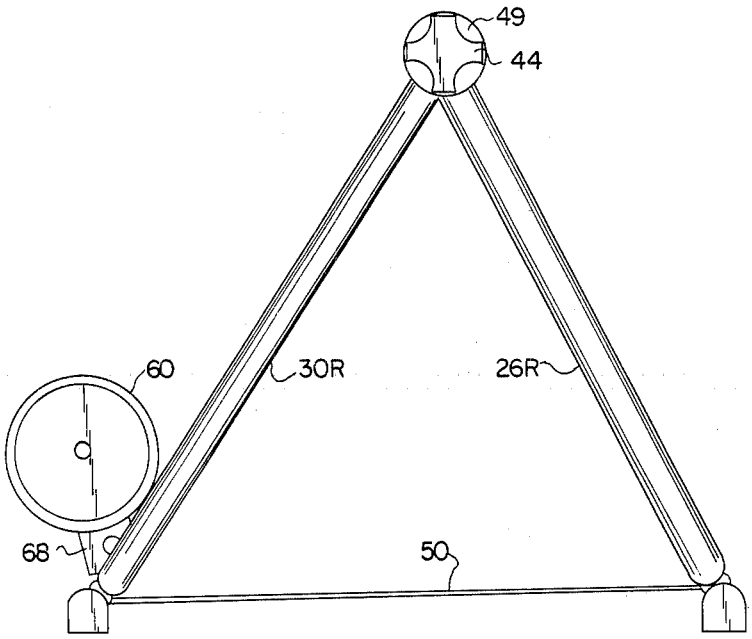
FIG. 2 is a side elevational view of the present invention.

As should appear obvious to one skilled in the art, the length of the arms 26L, 26R, 30L and 30R must be greater than the radius of the rear wheel 14, such that the rear wheel can be held off the ground to permit its free rotation within the frame 12. A lower frame support member, is joined from the base 28 of the rearward U-shaped bracket 22 to the base 24 of the forward U-shaped bracket 20, and serves to limit the longitudinal space between the rearward bracket 22 and the forward bracket 20. In the preferred embodiment, the strap 50 is formed from a nylon fabric strap which acts only in tension to restrain the longitudinal divergence of the brackets 20 and 22. It is therefore to be realized that the strap 50 serves to form the base of a support structure for each side of the rear wheel, consisting of the two upraised arms 26R, 30R and the strap 50 on the right side of the rear wheel 14, as is best seen in FIG. 2, and the arms 26L, 30L and the strap 50 on the left side of the rear wheel 14. It is therefore to be appreciated that each side of the rear wheel 14 is supported by a support structure having upraised portions 26R, 30R on the right side and 26L, 30L on the left side, each of which portions are disposed to substantially lie in a plane that is substantially parallel to the longitudinal axis of said bicycle that passes through the center axle of both the front and rear wheels of the bicycle; said longitudinal axis being represented by line 53 in FIGS. 1 and 4.

While the preferred emodiment, as shown and described, utilizes substantially "U" shaped brackets having substantially parallel upwardly extending arms, it is within the contemplation of the invention that the upwardly extending arms could be formed to diverge or converge in their upward extension. Likewise, curved arms (including a continuously curved bracket member) rather than the straight arms are contemplated. Additionally, upwardly extending arms that are separate elements, that is, not portions of "U" shaped members are contemplated.

Figure 6:
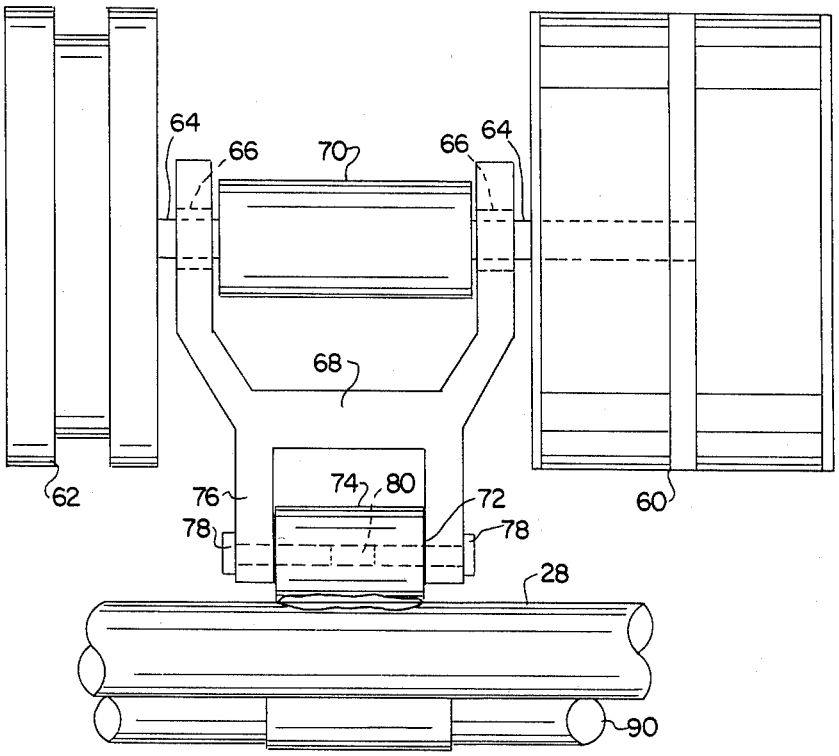
FIG. 6 is an end elevational view taken along lines 6—6 of FIG. 4.

In the preferred embodiment the exercise load for the rear wheel utilizes a wind cage 60 that is axially coupled to a fly wheel 62. As is depicted FIG. 6, the load axle 64 is journalled in bearings 66 that are held in an adjustable mounting bracket 68. A rear wheel engaging roller 70 is centrally disposed on the load axle 64, between the bearings 66, to provide frictional engagement of the load to the tire of the rear wheel 14. Load mechanisms of this type are well known in the prior art. To adjust the load, relative to the rear wheel radius, such that rear wheels of different diameters can be accomodated in the device, the preferred embodiment utilizes a hinge mechanism 72 in the mounting bracket 68. As is depicted in FIG. 6, the mounting bracket 68 consists of a lower portion 74 which is welded to the center of the base 28 of the rearward U-shaped bracket 22 and an upper structure 76 which contains the bearings 66 for the load axle 64. The upper structure 76 and the lower portion 74 are joined together using two hinge bolts 78 which pass through holes formed in the upper structure 76 and are threadably engaged in a threaded hole 80 formed in the lower portion 74. It is therefore to be realized that upon the loosening of the hinge bolts 78, that the upper structure 76 can rotate relative to the lower portion 74, whereby the device can accomodate rear wheels having different radii within the rotational arc of the distance between the hinge bolts 78 and the load axle 64.

To provide lateral stability to the frame 12, a lateral support bar 90 is welded to each base 24 and 26 of each U-shaped bracket 20 and 22, such that the support bars 90 extend laterally and substantially in the plane of the U-shaped brackets 20 and 22. The support bars 90 serve to prevent tipping of the bicycle when it is utilized for exercising.

Figure 7:
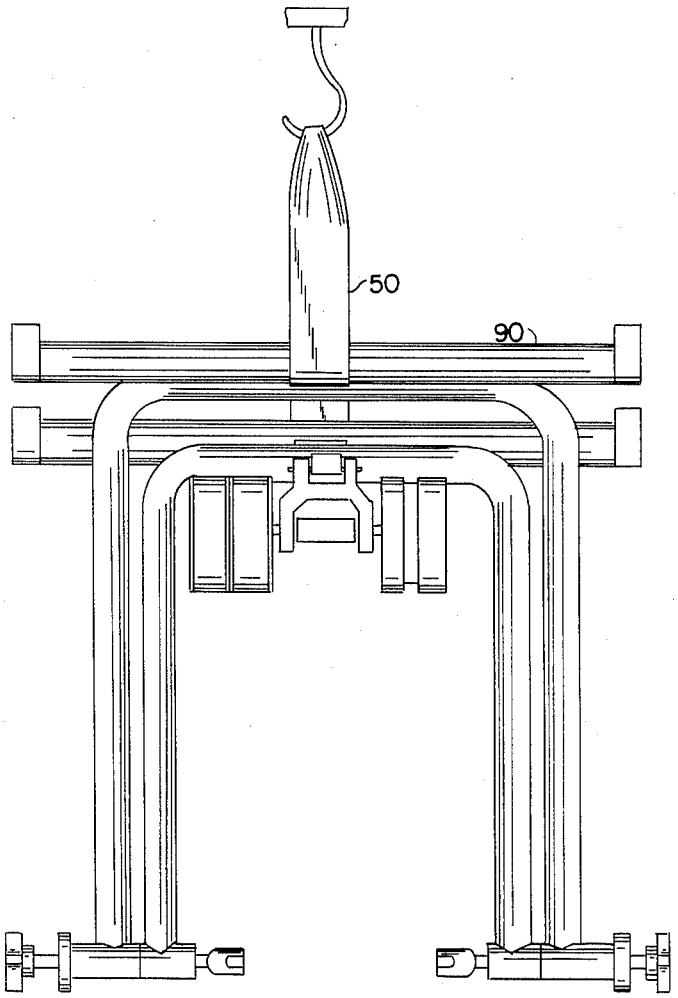
FIG. 7 is an end elevational view of the present invention when collapsed for transportation or storage.

As depicted in FIG. 7, an additional feature of the present invention is its collapsible design. The collapsible nature of the design is facilitated by the utilization of the tension only member 50 as the lower support strap. Due to the mounting bolt 42 passing through aligned mounting holes 40 in the mounts of the upper ends of each of the arms and the collapsable lower strap 50, the frame may be collapsed by applying compression forces at the bases of the U-shaped brackets 20 and 22, such that the arms 26L, 26R and 30L, 30R pivot about the mounting bolts 42. The strap, when collapsed, may serve as a transportation handle or hanging strap for the device when stored on a wall.

While the invention has been particularly shown and described with reference to certain preferred embodiments, it will be understood by those skilled in the art that various alterations and modifications in form and detail may be made therein. Accordingly, it is intended that the following claims cover all such alterations and modifications as fall within the true spirit and scope of the invention.

What I claim is:

1. A bicycle exercising apparatus adapted to reside on a ground surface having a frame that supports a bicycle engaged within said apparatus at the rear wheel of said bicycle, comprising:

a frame including two support structures that are engaged to each other, one said support structure being located on one side of said rear wheel, and the other support structure being located on the other side of said rear wheel;

each said support structure including a frame members adapted to provide support to the axle of said rear wheel, said frame members being disposed to substantially lie in a plane that is substantially parallel to the longitudinal axis of said bicycle that passes through the center axle of both the front and rear wheels of said bicycle;

each of said support structures including a bicycle supported means being joined to said frame members of said support structure proximate said rear wheel axle and adapted to support said bicycle proximate said rear wheel axle;

each said bicycle support means including a threaded rear axle mounting bolt having an outward end and an inward end; said bolt being threadably engaged with one of said frame members and slidably engaged with another of said frame members; whereby said frame members may be provided with respect to each other about said bolt and said frame may be collapsed for transportation and storage;

said bicycle support means further including an axle engaging means being fixedly engaged to said inward end of said mounting bolt and adapted to releasably engage the rear axle of said rear wheel;

a load means being engaged to said frame and disposed to make rotational contact with the tire of said rear wheel and supply a resistive force to the rotation of said rear wheel.

2. A bicycle exercising apparatus as described in claim 1 wherein said frame includes a base structure comprising horizontally disposed further frame members that are engaged to said frame members forming said support structures, and wherein said support structures extend upwardly from said base structure;

portions of said base structure being formed for contact with the ground surface that supports said apparatus; said horizontally disposed further frame members extending laterally relative to said longitudinal axis of said bicycle to provide lateral support for said apparatus.

3. A bicycle exercising apparatus as described in claim 2 wherein said load means is engaged to said base structure of said frame utilizing an adjustable engagement mechanism, formed to adjustably vary the distance between said axle of said rear wheel and said load means, whereby rear wheels of differing radii may be supported within said apparatus.

4. A bicycle exercising apparatus as described in claim 1 wherein said load means is engaged to said frame utilizing an adjustable engagement mechanism, formed to adjustably vary the distance between said axle of said rear wheel and said load means, whereby rear wheels of differing radii may be supported within said apparatus.

5. A bicycle exercising apparatus as described in claim 1 wherein each said frame member is formed with a mounting bolt support member, each said mounting bolt support member having a horizontally disposed bore passing therethrough;

each said mounting bolt being threadably engaged in said bore of one said mounting bolt support member and slidably engaged in the bore of another said mounting bolt support member; said bores of each said mounting bolt support member that support a mounting bolt being horizontally aligned such that said mounting bolt passes horizontally therethrough and such that said inner end of said mounting bolt is disposed proximate said rear wheel axle.

6. A bicycle exercising apparatus as described in claim 5 wherein said external end of each said threaded mounting bolt is formed with handle for the manual rotation of said mounting bolt;

a lock nut being disposed upon and threadably engaged to each said mounting bolt, said lock nut being disposed to make frictional contact with a mounting bolt support member to lock said mounting bolt in relation to its threaded engagement in said mounting bolt support member.

7. A bicycle exercising apparatus having a frame that supports a bicycle engaged within said apparatus at the rear wheel of said bicycle, comprising:

a frame including two support structures, one said support structure being disposed on one side of said rear wheel and said other support structure being disposed on the other side of said rear wheel;

each said support structure including two upwardly extending arms that converge to form an upper vertex of said support structure, and wherein one of said two arms depends downwardly and rearwardly from said vertex and is joined to a rearward base member at its lower extremity, and the other of said two arms depends downwardly and forwardly from said vertex and is joined to a forward base member at its lower extremity;

said rearward base member and said forward base member being joined together by an interconnecting frame member therebetween;

said rearward base member being disposed to engage the lower extremity of both said rearwardly depending arms from the two support structures, and said forward base member being disposed to engage the lower extremity of both said forwardly depending arms;

two rear axle support means, one of which is joined to each said support structure proximate the vertex thereof and disposed to support said rear wheel proximate the rear axle thereof;

each said rear axle support means including a threaded rear axle mounting bolt, having an outward end and an inward end; said bolt being threadably engaged with one of said arms proximate the upward extremity thereof and slidably engaged with said other of said two arms proximate the upward extremity thereof; whereby said two arms may be pivoted with respect to each other about said bolt, and said frame may be collapsed for transportation and storage;

said rear axle support means further including an axle engaging means fixedly engaged to said inward end of said mounting bolt and adapted to releaseably engage the rear axle of said rear wheel;

a load means being engaged to said frame and disposed to make rotational contact with the tire of said rear wheel and supply a resistive force to the rotation thereof.

8. A bicycle exercising apparatus as described in claim 7 wherein said load means is engaged to said frame utlizing an adjustable engagement mechanism, formed to adjustably vary the distance between said axle of said rear wheel and said load means, whereby rear wheels of differing radii may be supported within said apparatus.

9. A bicycle exercising apparatus as described in claim 7 wherein said interconnecting frame member is formed as a tension member only, such that said interconnecting frame member is collapsible upon compression thereof.

10. A bicycle exercising apparatus as described in claim 7 wherein a mounting bolt support member is engaged to each said arm proximate the upper extremity of each said arm, each said mounting bolt support member having a horizontally disposed bore passing therethrough;

each said mounting bolt being threadably engaged in the bore of one mounting bolt support member and slidably engaged in the bore of another of said mounting bolt support members;

said bores of each said mounting bolt support member being horizontally aligned such that said mounting bolt passes horizontally therethrough and such that said inner end of said mounting bolt is disposed proximate said rear wheel axle.

11. A bicycle exercising apparatus as described in claim 10 wherein said external end of each said threaded mounting bolt is formed with a handle for the manual rotation of said mounting bolt;

a lock nut being disposed upon and threadably engaged to each said mounting bolt, said lock nut being disposed to make frictional contact with a mounting bolt support member to lock said mounting bolt in relation to its threaded engagement in said mounting bolt support member.

12. A bicycle exercising apparatus having a frame that supports a bicycle engaged within said apparatus only at the rear wheel of said bicycle, comprising;

a frame including two U-shaped bracket members being disposed such that the base of each said U-shaped bracket is positioned downwardly and the arms of each U-shaped bracket extend upwardly;

each said U-shaped bracket being disposed relative to said rear wheel such that said rear wheel rotates within the mouth of each said U-shaped bracket, such that said arms of each said U-shaped bracket are disposed on different sides of said rear wheel;

said arms from each said U-shaped bracket that are disposed on the same side of said rear wheel being engaged at the upper ends thereof to a threaded rear axle mounting bolt having an outward end and an inner end; said bolt being threadably engaged with one of said arms and slidably engaged with the other of said arms; whereby said two arms may be pivoted with respect to each other about said bolt, and said frame may be collapsed for transportation and storage;

said mounting bolt further including a rear axle engaging means fixedly engaged to said inward end of said mounting bolt and adapted to releaseably engage the rear axle of said rear wheel;

an interconnecting frame means being joined to said base of each said U-shaped bracket and acting to hold said base of each said U-shaped bracket in spaced apart relation relative to each other; and a load means being engaged to said frame and disposed to make rotational contact with the tire of said rear wheel and supply a resistive force to the rotation of said rear wheel.

13. A bicycle exercising apparatus as described in claim 12 wherein said interconnecting frame means includes a frame member which acts in tension only such that said interconnecting frame means is collapsible upon compression thereof.

14. A bicycle exercising apparatus as described in claim 12 wherein a mounting bolt support member is engaged to the upper end of each said arm, each said mounting bolt support member having a horizontally disposed bore passing therethrough;

each said mounting bolt being threadably engaged in the bore of one said mounting bolt support member and slidably engaged in the bore of another said mounting bolt support member;

said bore of each said mounting bolt support member being horizontally aligned such that said mounting bolt passes horizontally therethrough and such that said inner end of each said mounting bolt is disposed proximate said rear wheel axle.

15. A bicycle exercising apparatus as described in claim 14 wherein said external end of each said threaded mounting bolt is formed with a handle for the manual rotation of said mounting bolt;

a lock nut being disposed upon and threadably engaged to each said mounting bolt, each said lock nut being disposed to make frictional contact with a mounting bolt support member to lock said mounting bolt in relation to its threaded engagement in said mounting bolt support member.

* * * * *

UNITED STATES PATENT OFFICE

CERTIFICATE OF CORRECTION

Patent No. 4,768,782 Dated September 6, 1988

Inventor(s) James R. Blackburn

It is certified that error appears in the above-identified patent and that said Letters Patent is hereby corrected as shown below:

Column 5, Line 13, delete "a"

Column 5, Line 21, delete "suported" and insert -- support --

Column 5, Line 31, delete "provided" and insert -- pivoted --

Column 6, Line 17, following "with" insert -- a --

Column 7, Line 7, delete "utlizing" and insert -- utilizing --

Column 7, Line 7, following "mechanism" delete ","

Signed and Sealed this

Sixth Day of June, 1989

*Attest:*

DONALD J. QUIGG

*Attesting Officer*

*Commissioner of Patents and Trademarks*